US010888733B2

(12) United States Patent
Earls et al.

(10) Patent No.: US 10,888,733 B2
(45) Date of Patent: Jan. 12, 2021

(54) FOAM EXERCISING ROLLER

(71) Applicants: DeLovell Earls, Hermosa Beach, CA (US); Andrew Smith, Colorado Springs, CO (US); Charles Lewis, Cambridge, MA (US)

(72) Inventors: DeLovell Earls, Hermosa Beach, CA (US); Andrew Smith, Colorado Springs, CO (US); Charles Lewis, Cambridge, MA (US)

( * ) Notice: Subject to any disclaimer, the term of this patent is extended or adjusted under 35 U.S.C. 154(b) by 207 days.

(21) Appl. No.: 15/595,084

(22) Filed: May 15, 2017

(65) Prior Publication Data

US 2018/0326254 A1 Nov. 15, 2018

(51) Int. Cl.

| | |
|---|---|
| ***A63B 21/00*** | (2006.01) |
| ***A63B 26/00*** | (2006.01) |
| ***A61H 15/00*** | (2006.01) |
| ***A61H 1/02*** | (2006.01) |
| ***A63B 23/00*** | (2006.01) |
| ***A63B 22/16*** | (2006.01) |

(52) U.S. Cl.

CPC ..... *A63B 21/4039* (2015.10); *A61H 1/0292* (2013.01); *A61H 15/00* (2013.01); *A63B 26/003* (2013.01); *A61H 2015/0014* (2013.01); *A61H 2201/0157* (2013.01); *A61H 2201/0161* (2013.01); *A61H 2201/1261* (2013.01); *A61H 2201/168* (2013.01); *A61H 2201/169* (2013.01); *A61H 2201/1623* (2013.01); *A61H 2201/1695* (2013.01); *A61H 2203/0443* (2013.01); *A61H 2205/062* (2013.01); *A61H 2205/081* (2013.01); *A61H 2205/086* (2013.01); *A63B 22/16* (2013.01); *A63B 2023/006* (2013.01)

(58) Field of Classification Search

CPC ..... A63B 21/4039; A63B 26/003; A63B 2023/006; A63B 22/16; A61H 1/0292; A61H 15/00; A61H 2205/086; A61H 2205/081; A61H 2205/062; A61H 2203/0443; A61H 2201/1695; A61H 2201/169; A61H 2201/168; A61H 2201/1623; A61H 2201/1261; A61H 2201/0161; A61H 2201/0157; A61H 2015/0014

See application file for complete search history.

(56) References Cited

U.S. PATENT DOCUMENTS

| | | | | |
|---|---|---|---|---|
| 1,274,595 A * | 8/1918 | Ranz | A47G 9/10 5/636 |
| 2,273,710 A * | 2/1942 | Klaes | A61H 15/0092 601/119 |
| 2,501,270 A * | 3/1950 | Fleming | A45C 5/00 206/315.11 |
| 2,943,621 A * | 7/1960 | Phillips | A61H 23/0218 5/636 |
| 4,948,303 A * | 8/1990 | Good | B65G 51/06 406/184 |

(Continued)

*Primary Examiner* — Garrett K Atkinson
(74) *Attorney, Agent, or Firm* — Hanes & Bartels LLC

(57) ABSTRACT

An exercise foam roller having a plurality of elongated tube sectors where each sector has first and second longitudinal edges with at least a portion of the outer surface covered with foam and hinges interconnecting the tube sectors along their first longitudinal edges and fasteners detachably interconnecting the tube sectors along their second longitudinal edges.

7 Claims, 4 Drawing Sheets

(56) References Cited

U.S. PATENT DOCUMENTS 5,028,030 A * 7/1991 Lewis ..... A47G 1/20 248/218.2
5,114,012 A * 5/1992 Mushinski ..... B65B 25/148 206/389
5,143,056 A * 9/1992 Yih-Jong ..... A61H 15/00 601/118
D341,509 S * 11/1993 Evans ..... D6/601
5,291,625 A * 3/1994 Leslie ..... A47C 27/081 5/420
5,335,809 A * 8/1994 Toida ..... A47J 41/0011 220/23.88
5,425,194 A * 6/1995 Miller ..... A01K 97/08 206/315.11
5,475,948 A * 12/1995 Parke ..... E06B 7/2316 49/470
5,554,102 A * 9/1996 Chiou ..... A61H 15/0092 601/118
5,572,757 A * 11/1996 O'Sullivan ..... A47C 7/46 297/284.5
5,637,065 A * 6/1997 Chang, Sr. ..... A63B 23/14 482/1
5,655,677 A * 8/1997 Fratello ..... B65G 51/06 220/4.22
5,802,644 A * 9/1998 Scheurer ..... A47G 9/10 5/640
5,901,966 A * 5/1999 Valerino, Sr. ..... B65G 51/06 277/548
6,015,246 A * 1/2000 Yamane ..... B65G 51/06 406/184
6,450,333 B1 * 9/2002 McClenahan ..... A01K 97/08 190/104
6,560,932 B2 * 5/2003 Heroux ..... E06B 7/2316 49/467
6,672,807 B1 * 1/2004 McIntyre ..... G07F 19/201 406/180
D497,961 S * 11/2004 Rolfes ..... D21/662
7,108,646 B1 * 9/2006 Quick ..... A47D 13/08 482/132
7,112,178 B1 * 9/2006 Roozenburg ..... A61H 1/0266 601/121
D546,380 S * 7/2007 Juarez ..... D18/35
7,387,599 B1 * 6/2008 Hsu ..... A61H 15/0092 482/122
7,401,439 B2 * 7/2008 Heroux ..... E06B 7/2316 277/921
7,607,538 B2 * 10/2009 Silvenis ..... A45C 11/24 206/528
7,918,774 B2 * 4/2011 Dye ..... A61H 15/0092 482/132
8,267,622 B1 * 9/2012 MacLean-Blevins ..... B65G 51/42 406/186
8,556,837 B1 * 10/2013 Poirier ..... A61H 15/00 601/46
8,701,350 B2 * 4/2014 Vulpitta ..... E06B 7/26 49/469
8,733,019 B2 * 5/2014 Vulpitta ..... E06B 7/2316 49/70
8,784,287 B2 * 7/2014 Miller, Jr. ..... A63B 22/20 482/132
8,926,482 B2 * 1/2015 Miller, Jr. ..... A63B 22/20 482/132
8,951,172 B2 * 2/2015 Marcus ..... A63B 21/075 482/106
9,073,708 B2 * 7/2015 Miller ..... B65G 51/04
9,463,133 B2 * 10/2016 Rodgers ..... A61H 7/00
9,550,088 B2 * 1/2017 Coompol ..... A63B 21/0724
9,592,969 B2 * 3/2017 Wolfe ..... B65G 51/44
9,616,313 B2 * 4/2017 Townsend ..... A45C 9/00
9,839,574 B2 * 12/2017 Lawrie ..... A61H 15/0092
9,889,338 B2 * 2/2018 Yu ..... A63B 21/4039
9,961,987 B1 * 5/2018 Harper ..... A45F 3/047
D822,772 S * 7/2018 Jorgenson ..... D21/662
10,137,055 B2 * 11/2018 Lawrie ..... A61H 15/0092
D839,025 S * 1/2019 Casta-Baez ..... D6/601
10,265,583 B1 * 4/2019 Zaffino ..... A63B 26/003
D872,198 S * 1/2020 Kim ..... D21/662
2008/0090707 A1 * 4/2008 Dye ..... A61H 15/0092 482/132
2009/0057189 A1 * 3/2009 Silvenis ..... A61J 1/035 206/570
2010/0274165 A1 * 10/2010 Evans ..... A61H 15/00 601/122
2012/0150082 A1 * 6/2012 Davis ..... A61H 15/0092 601/118
2012/0322633 A1 * 12/2012 Holman ..... A63B 21/028 482/123
2013/0123078 A1 * 5/2013 Marji ..... A61H 15/00 482/139
2013/0178766 A1 * 7/2013 Abdur-Raoof ..... A61H 15/00 601/19
2013/0178768 A1 * 7/2013 Dalebout ..... A61H 15/0092 601/46
2013/0261517 A1 * 10/2013 Rodgers ..... A61H 7/00 601/121
2014/0128786 A1 * 5/2014 Ross ..... A61H 15/0092 601/118
2015/0190304 A1 * 7/2015 Lawrie ..... A61H 15/0092 601/118
2016/0059063 A1 * 3/2016 Breibart ..... A63B 23/185 482/123
2017/0071817 A1 * 3/2017 Sanchez ..... A61H 15/00
2017/0156479 A1 * 6/2017 Kwong ..... A45F 4/02
2018/0071166 A1 * 3/2018 Lawrie ..... A61H 15/0092
2018/0257832 A1 * 9/2018 Loeffler ..... A45C 11/00

* cited by examiner

FOAM EXERCISING ROLLER

The present invention relates generally to a personal exercise and myofascial release device in the form of a foam covered roller.

BACKGROUND

Foam rollers have been growing in popularity in recent years. Using a foam roller is the best way to perform self-massage and myofascial release. Used before exercise foam rolling can increase blood flow and prepare the muscles for exercise. A foam roller can also help loosen tight muscles, reduce muscle adhesions and scar tissue formation and increase body flexibility.

The simplest form of such a roller is a round tube of foam that looks like a rolling pin. More advanced designs include, on the surface of the foam, flexible bumps for muscle penetration and treatment of trigger points along with variations of the density of the foam. From solid core rollers, the prior art includes hollow core tubes whose outside surface is covered with smooth or textured grid patterns. The interior of the hollow tube version has seen use as storage space with end caps on the tube to retain the stored contents.

The primary object of the present invention is to provide a foam roller construction that will provide easy access to the interior of the roller for storage of such items as exercise floor mats but will, at the same time allow the roller to be unfolded into two adjacent tube halves whose outside foam covered grid surfaces provide stationary support for a different kind of muscle therapy than that administered by a roller.

A second object of the invention is to provide a foam roller whose entire interior can be viewed and easily accessed for storage purposes by utilizing hinged tube halves to create the roller where the tube halves pivot around hinges to open the roller in the manner of a suitcase for ease of storage and retrieval.

Other further objects, features and advantages of the present invention will become apparent from the following description of the invention taken in conjunction with the accompanying drawings.

SUMMARY OF THE INVENTION

The roller of the present invention comprises two identical cylindrical tube halves that are interconnected with hinges along a first one of their longitudinal edges. A fastening mechanism is provided to selectively lock the second longitudinal edges together, thus forming a cylinder. The outside surface of the cylinder is covered with a foam material such as ethylene-vinyl acetate which may be smooth or grooved or textured with grid forming dimples, flexible bumps or tread on all or a portion of the outside surface of the roller. The interior of the formed cylinder may be used for storage of such items as an exercise floor mat and additional storage spaces in the form of compartments are also provided. An alternative embodiment of the roller may be shorter in length than a rolled exercise matt with the matt being retained between the closed roller halves. With these novel features the foam covered cylinder may be used as an exercise roller for performing self-massage and myofascial and trigger point release. Exercises can be performed with the cylinder opened with the longitudinal edges of the tube halves in contact with the floor. In that configuration the foam covered tube halves become stationary and useful as fixed pressure points for areas of the body such as the gluteus maximus or for core exercises such as sit-ups, using the stationary tube halves as a fulcrum. Following the roller exercise regimen, the roller is opened and the exercise mat may be conveniently secured within the roller.

DETAILED DESCRIPTION OF THE INVENTION

Figure 1:
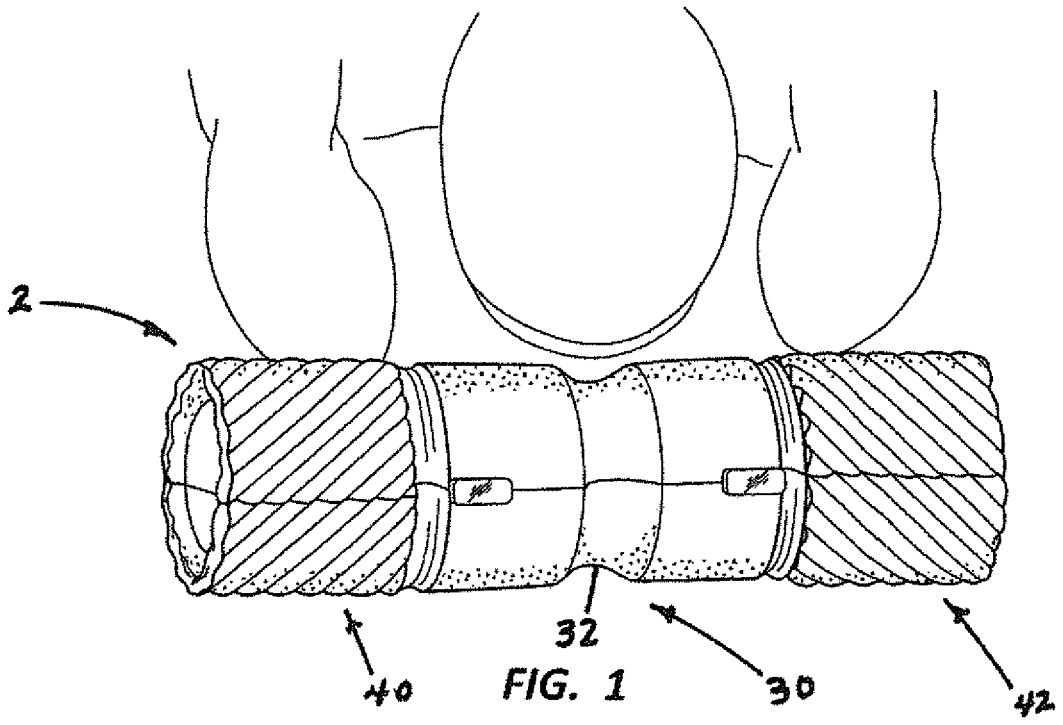
FIG. 1 is a perspective view of the preferred embodiment of the foam roller of the present invention showing an individual using the roller for back massage.
Figure 5:
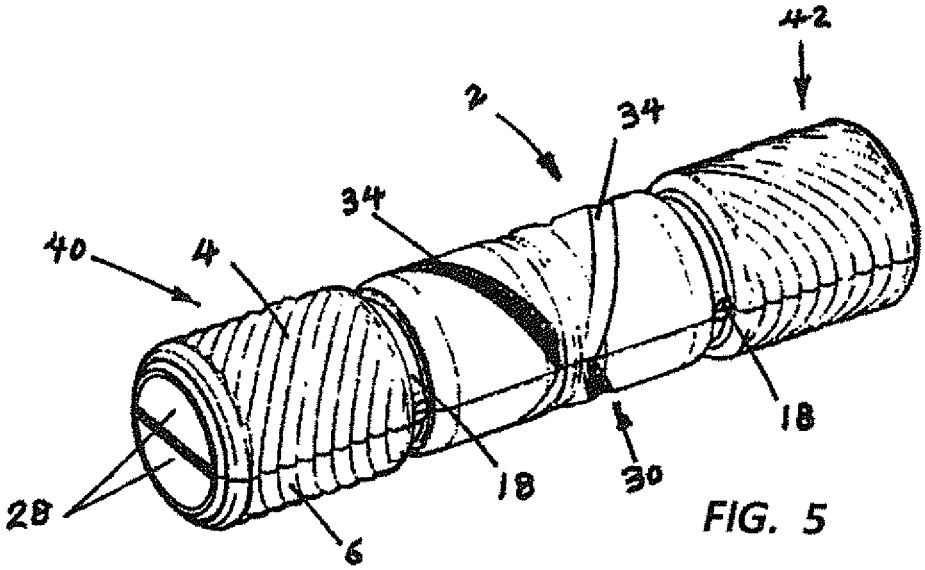
FIG. 5 is a perspective view of the roller with the tube halves closed.

The preferred form of the foam exercise roller 2 of the present invention is illustrated in FIGS. 1-5. The roller includes two identical tube halves 4 and 6, each having a longitudinal hinge edge 8 and 12 and each having a longitudinal closure edge 10 and 14. The tube halves 4 and 6 are pivotally interconnected along their longitudinal hinge edges 8 and 12 by hinges 16. The closure edges 10 and 14 of the tube halves are selectively interconnected by fastening bands 18. The roller 2, as seen in FIGS. 1 and 5, is formed when the tube halves are closed, that is, one or both halves are pivoted about hinges 16 until the closure edges 10 and 14 come into contact with each other. Closure of the tube halves is maintained by the circular bands around the roller whose ends are interlocked to secure the tube halves together in a cylindrical configuration. Conversely, the roller 2 is opened when the circular bands are disconnected and the tube halves are pivoted about the hinges 16 to the positions shown in FIGS. 2, 3 and 4.

Figure 3:
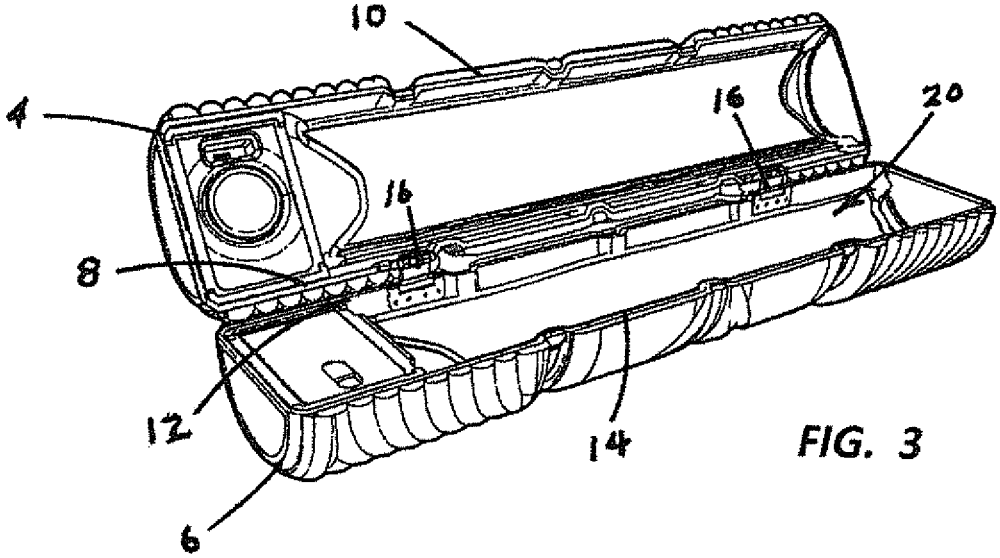
FIG. 3 is a perspective view of the preferred embodiment of the foam roller of the present invention in an open position revealing the interior storage space.
Figure 4:
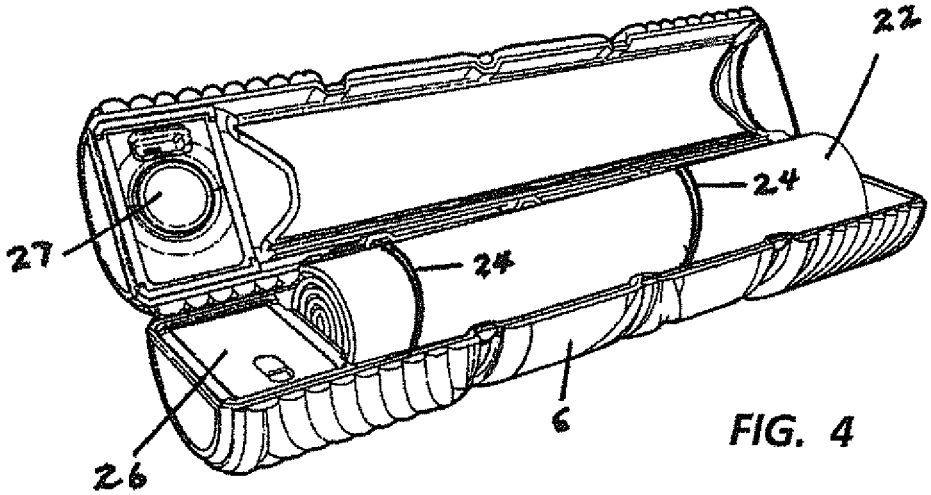
FIG. 4 is a perspective view of the roller in an open position and showing a rolled up exercise mat contained within the interior storage space.

The open position of the roller reveals the hollow interior of the tube halves 4 and 6 being utilized for storage space, generally indicated by reference numeral 20 in FIG. 3. The primary use for the storage space is to accommodate a rolled up exercise mat 22 secured in place by retaining straps 24 anchored to the tube half 6. The storage space can also include a removable compartment 26 in tube half 6 for keeping keys, credit cards and the like. A space in tube half 4 opposing the compartment 26 can be occupied by a number of other accessories such as an audio speaker 27. Each of the interior surfaces of the tube halves may be lined with netting to enclose various other items to be stored during use of the roller.

Semi-circular end caps 28 are disposed at the terminal ends of each tube half to complete the enclosure of the interior of the roller when the tube halves are closed. The end caps may be perforated with one or more apertures to allow for the passage of air through the interior of the roller.

The outer surface of each tube half is covered with one or more arrangements of foam. For most foam configurations ethylene-vinyl acetate is preferred. In the preferred embodiment there are multiple sections of foam covering, each of which may be covered with different kinds or densities of foam or different foam surface configurations to effect different kinds of muscle pressure. The center section 30 of the roller 2, that is, the combination of short sections on both sides of the circumferential groove 32 of the tube halves, is covered with a smooth surface variety of foam having broad grooves 34 angularly disposed to the longitudinal edges of the tube halves and traversing across the outer surface of the center section of foam, as shown in FIG. 5. The short sections are slightly spaced apart to accommodate the slight protrusion of portions of the human spine, as shown in FIG. 1.

The end portions 40 and 42 of each tube half are preferably covered with a higher density and roughly textured foam, including dimples, flexible bumps and narrow grooves adapted to apply the necessary local pressure to achieve the desired myofascial and trigger point release.

Figure 2:
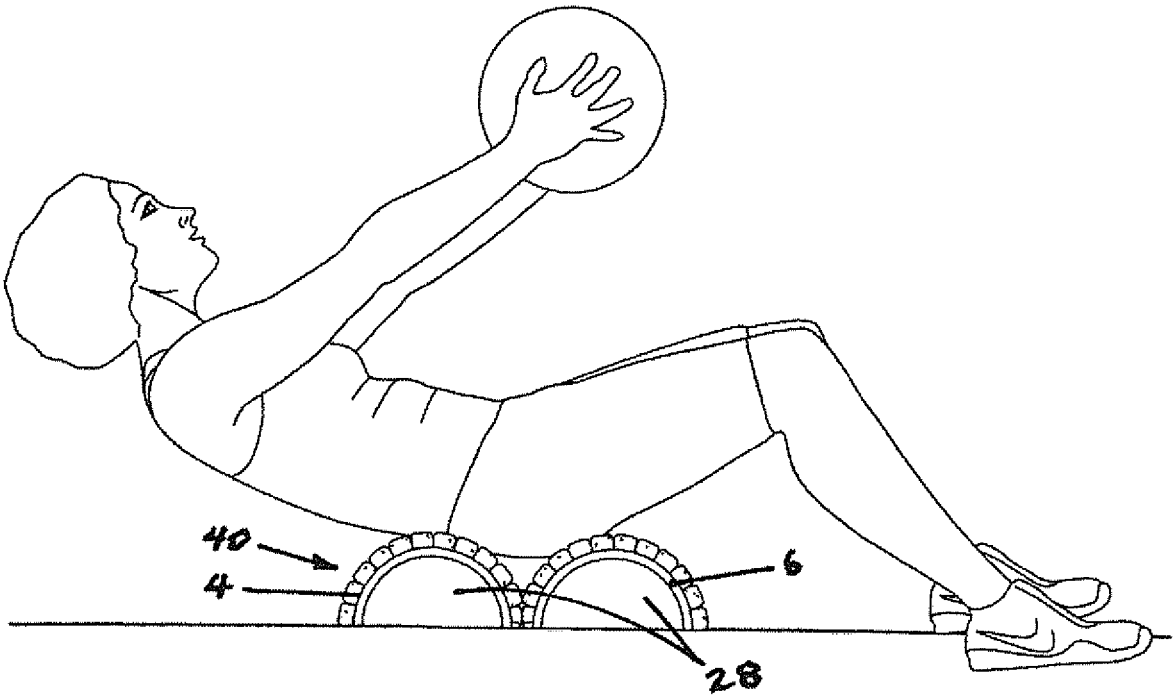
FIG. 2 is an end view of the roller in an open position with the longitudinal edges of the tube halves in contact with the floor and a person performing core exercises or sit-ups using the roller as a fulcrum.

As illustrated in FIG. 2, a different kind of massage is achieved by planting the open sides of the tube halves 4 and 6 on a floor surface where they remain relatively stationary while the one exercising moves over or around the textured grid surface to stimulate a broader area muscle such as the gluteus maximus. The stationary tube halves also act as a fulcrum for sit-ups.

Figure 6:
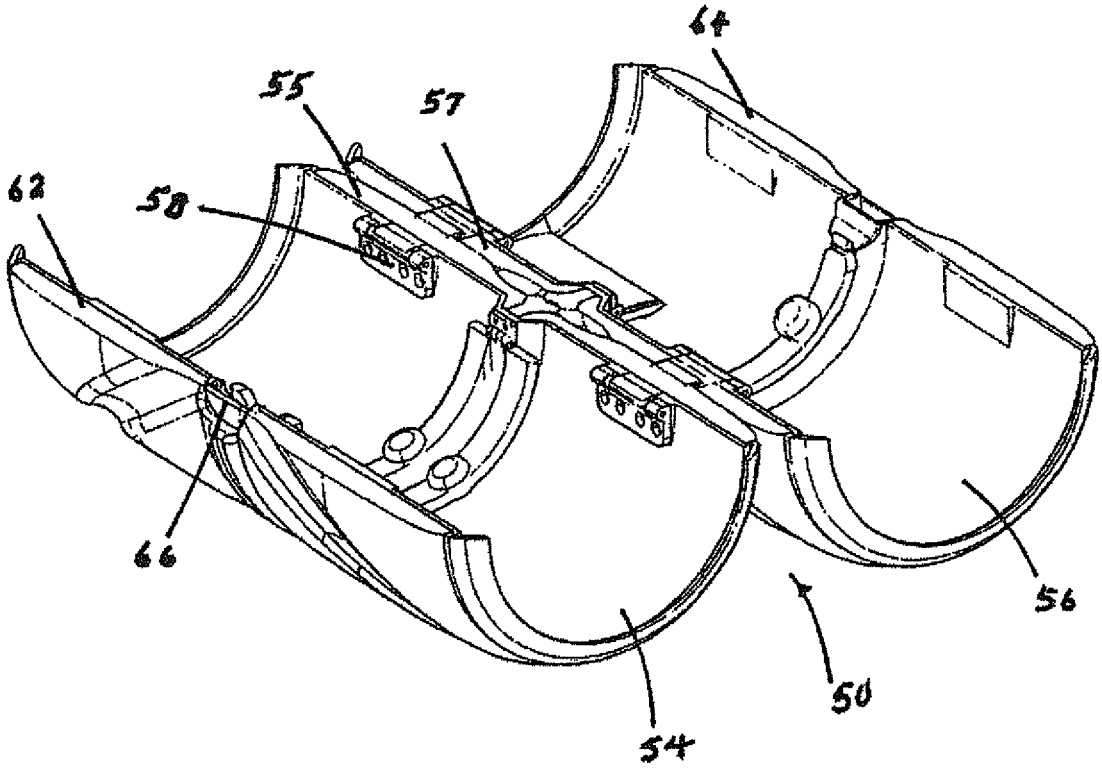
FIG. 6 is a perspective view of an alternate embodiment of the present invention in an open position and with mat retaining clasps in a retracted position against the inside surface of the tube halves.
Figure 7:
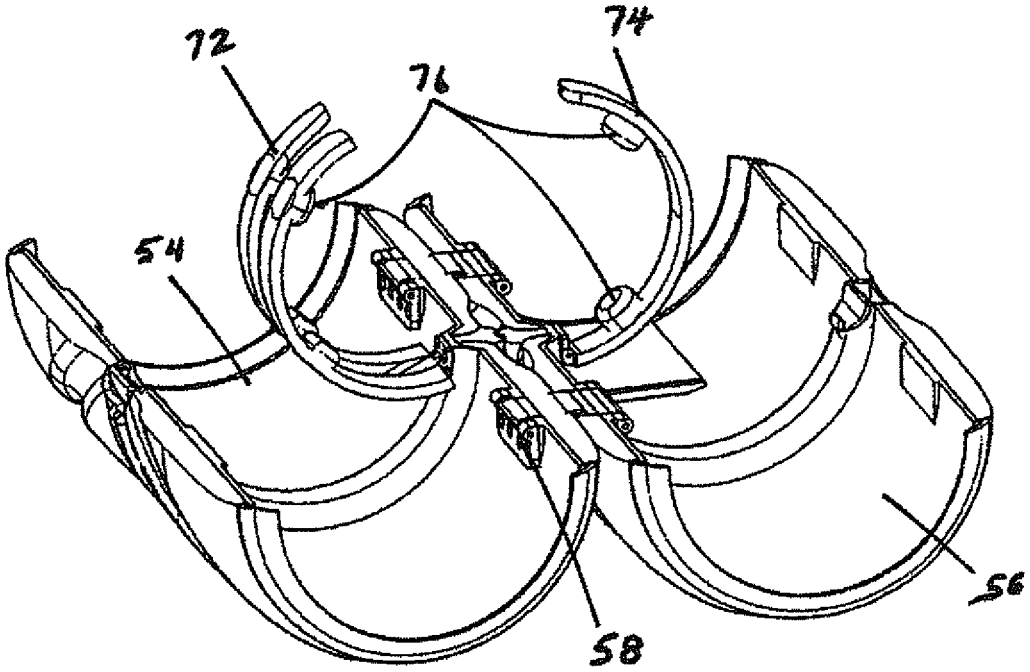
FIG. 7 is similar to FIG. 6 except the mat retaining clasps are in a raised position ready to receive and retain a rolled exercise mat.
Figure 8:
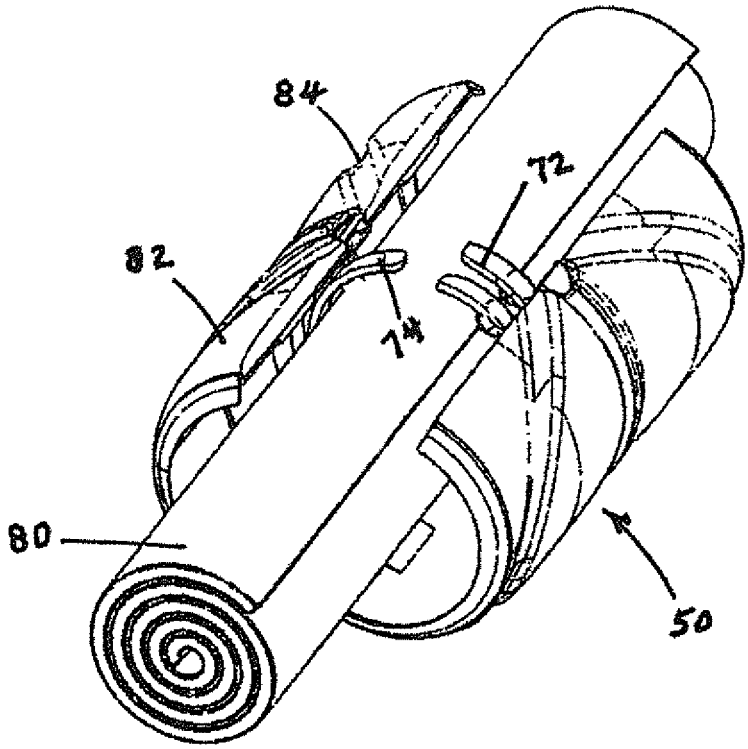
FIG. 8 is a perspective view of the alternate embodiment with the tube halves is a partially closed position.

FIGS. 6 through 8 depict an alternative embodiment of the present invention where the roller 50 is shorter in length than that of the preferred form but still provides apparatus for storing an exercise mat. Tube halves 54 and 56 are pivotally attached along inside longitudinal edges 55 and 57 by hinges 58. The roller 50 is formed by pivoting the tube halves to a position where the outer longitudinal edges 62 and 64 come into contact with each other. The contact between the outer edges is maintained by a latch 66, magnets or other form of fastener.

Pivotally hinged to the respective inside longitudinal edges are arcuate grasping arms 72 and 74 which are provided to hold an exercise mat 80 in storage within the roller 50 when the roller is not in use or in transit. Each of the arms carries extensible pressure nubs 76 that engage the body of the rolled exercise mat 80 to retain the mat within the arms when the tube halves are closed, as shown in FIG. 8.

Each of the tube halves of the alternative embodiment are preferably covered with ethylene-vinyl acetate foam 82 that carries broad angular grooves 84 or some other desired texture or a grid pattern which produces the local pressures that the roller applies to muscles of the body.

We claim:

1. An exercise roller, comprising, a pair of elongated cylindrical tube halves each having,
- terminal ends,
- a longitudinal center section and first and second end portions,
- first and second longitudinal edges,
- hinge means for interconnecting the tube halves along their first longitudinal edges,
- means for detachably interconnecting the tube halves along their second longitudinal edges to form a cylinder,
- a smooth surface low density foam covering the longitudinal center section of each tube half, and
- a higher density foam surface covering the first and second end portions of each tube half.

2. The exercise roller of claim 1 and further including semi-circular end caps disposed at the terminal ends of each tube half.

3. The exercise roller of claim 1 where the hinge means allow the cylindrical tube halves to be rotated one hundred eighty degrees with respect to each other forming adjacent similarly oriented cylindrical tube halves.

4. The exercise roller of claim 3 and further including at least one removable accessory compartment within one of the tube sectors.

5. An exercise foam roller, comprising, a pair of elongated rigid cylindrical tube sectors, each having,
- first and second terminal ends,
- an integral semi-circular end-enclosure cap disposed at each of the first and second terminal ends,
- first and second longitudinal edges,
- an outer surface, and
- foam covering at least a portion of the outer surface, hinge means for interconnecting the tube sectors along their first longitudinal edges where the hinge means allow the cylindrical tube halves to be rotated one hundred eighty degrees with respect to each other forming adjacent similarly oriented cylindrical tube halves that when the longitudinal edges are placed on a floor the tube sectors form an exercise fulcrum, means for detachably interconnecting the tube sectors along their second longitudinal edges to form an enclosed cylinder for the storage of exercise accessories.

6. The exercise foam roller of claim 5 and further including, a pair of opposed arcuate arms pivotally attached to the respective first longitudinal edges of the tube halves for securing exercising accessories disposed within the interconnected tube halves.

7. An exercise roller, comprising, first and second rigid semi-cylindrical base members, each having,
- first and second coplanar longitudinal edges,
- first and second terminal ends,
- end-enclosing flat semi-circular caps disposed at each of the terminal ends, hinge means for interconnecting the base members along their first longitudinal edges where the hinge means allow the base members to be rotated to a position where the first and second longitudinal edges of the first and second base members are co planar when open, means for detachably interconnecting the base members along their second longitudinal edges to form an enclosed cylinder when closed for storage of exercise accessories.

* * * * *